US008720350B2

(12) United States Patent
Bush

(10) Patent No.: US 8,720,350 B2
(45) Date of Patent: May 13, 2014

(54) PALLET, METHOD OF MANUFACTURING AND METHOD OF TRANSPORTING OR HANDLING GOODS

(71) Applicant: Bryan Bush, Havant (GB)

(72) Inventor: Bryan Bush, Havant (GB)

(73) Assignee: Xyratex Technology Limited, Havant (GB)

( * ) Notice: Subject to any disclaimer, the term of this patent is extended or adjusted under 35 U.S.C. 154(b) by 0 days.

(21) Appl. No.: 13/628,765

(22) Filed: Sep. 27, 2012

(65) Prior Publication Data

US 2014/0086718 A1 Mar. 27, 2014

(51) Int. Cl.
*B65D 19/38* (2006.01)

(52) U.S. Cl.
USPC ..... 108/57.12

(58) Field of Classification Search
USPC ..... 108/51.11, 57.12, 56.1, 56.3, 57.33; 248/615, 618, 622, 632–636
See application file for complete search history.

(56) References Cited

U.S. PATENT DOCUMENTS

| | | | | |
|---|---|---|---|---|
| 1,806,341 | A * | 5/1931 | Gavaza | 248/615 |
| 3,563,525 | A * | 2/1971 | Narabu | 267/140 |
| 4,705,257 | A * | 11/1987 | Leo et al. | 248/611 |
| 5,277,010 | A * | 1/1994 | Stephenson et al. | 52/403.1 |
| 6,418,862 | B1 * | 7/2002 | Heil | 108/57.12 |
| 6,609,467 | B2 * | 8/2003 | Monson et al. | 108/57.12 |
| 6,887,544 | B2 * | 5/2005 | Monson | 428/36.9 |
| 7,779,765 | B2 * | 8/2010 | Donnell et al. | 108/57.26 |
| 2008/0250987 | A1 * | 10/2008 | Hartel et al. | 108/57.12 |
| 2010/0044533 | A1 * | 2/2010 | King et al. | 248/188.5 |

* cited by examiner

*Primary Examiner* — Matthew Ing
(74) *Attorney, Agent, or Firm* — Pillsbury Winthrop Shaw Pittman LLP

(57) ABSTRACT

A pallet for transportation and handling of goods includes a base and a deck above the base for supporting goods. The pallet includes at least one location element that is provided between the deck and the base arranged to substantially limit lateral motion of the deck relative to the base. At least one isolator is provided between the deck and the base arranged to provide shock and vibration isolation to the deck from the base. In another aspect, the pallet includes at least one isolator between the deck and the base arranged to provide shock and vibration isolation to the deck from the base, the isolator including a resilient hollow shell that is open to the atmosphere in at least one place.

17 Claims, 5 Drawing Sheets

PALLET, METHOD OF MANUFACTURING AND METHOD OF TRANSPORTING OR HANDLING GOODS

The present invention relates to a pallet for transportation and handling of goods, a method of manufacturing a pallet and to a method of transporting or handling goods.

A pallet, sometimes called a skid, is a flat transport structure that supports goods in a stable fashion during transportation, storage or other handling. A pallet is usually adapted to being lifted by a forklift, pallet jack, front loader or other jacking device. A pallet is the structural foundation of a unit load which allows handling and storage efficiencies. Goods or shipping containers are often placed on a pallet secured with strapping, stretch wrap or shrink wrap and shipped. Alternatively, crates can be built with a pallet at the base.

Most pallets are wooden. However, pallets also are made of plastic, metal, and paper. Each material has advantages and disadvantages relative to the others.

Many different construction principles are known. Generally a wooden pallet has a base and a deck and "bearer" structural elements supporting the deck above the base whilst leaving space for forklift arms to load the pallet. A two-way pallet typically has solid bearers which extend from the front to the rear of the pallet and which prevent fork lift access from the sides of the pallet. A four-way pallet has blocks or posts in a matrix arrangement for supporting the deck, which enables access from either end or the sides of the pallet. The deck and base may be formed from solid boards or from plural deck boards in which case stringers are also usually provided.

It is known to include cushioning material with a pallet to moderate the shocks and vibrations incurred in the distribution system (i.e. trucks, trains, airplanes, ships or just handling whilst loading/unloading). FIG. 1 shows an example of a typical cushioned pallet 20 where the posts 23 include cushioning blocks made from expanded polyethylene foam or the like between the deck 21 and the base 22. The foam blocks provide some protection against shock and vibration reaching the load on the deck 21. The performance of the cushioning material is published by the cushion manufacturer and the designer calculates the density and amount of material required in the design. However, the performance of the cushioning material is usually very limited in the range of loads that can be handled whilst still providing a useful cushioning effect.

Another known system uses air dampened cushioning devices known as SKID-MATEs (RTM). As shown by FIG. 2A, the SKID-MATEs 43 can be attached under the base 42 of a crate or pallet 40 creating an air-ride cushion in place of hardwood skid runners. The devices provide a cushioning to protect sensitive products loaded on the deck 41 of the pallet 40 from shock and vibration. As shown by the sectional view of FIG. 2B, a SKID-MATE 43 comprises a plastic annular air filled element which can be bolted to a pallet 40 by a bolt 44 through the hole in the annulus. A SKID-MATE has a narrow, specific load range. Users have to calculate their requirements and choose the appropriate SKID-MATE to their load. Thus, a pallet fitted out with SKID-MATEs is not suitable for shipping goods with a wide range of different weights.

According to a first aspect of the present invention, there is provided a pallet for transportation and handling of goods, the pallet comprising: a base; a deck above the base for supporting goods; at least one location element between the deck and the base arranged to substantially limit lateral motion of the deck relative to the base; and, at least one isolator between the deck and the base arranged to provide shock and vibration isolation to the deck from the base.

The term "pallet" as used herein includes skids, crates build onto pallets and the like. The locating element helps keep the displacement of the deck relative to the base in a single axial direction which helps obtain the best performance from the isolators. This provides a stable deck for the load. The isolators provide shock and vibration protection to the load. Accordingly, the preferred pallet provides an improved platform for shipping and handling goods compared to prior art pallet cushioning schemes. For example, a conventional way of equipping a pallet with SKID-MATEs does little to maintain stability of the pallet as the deck can move in more than one axis relative to the floor under the SKID-MATEs, as there is no mechanical elements to prevent the pallet moving pitching from side to side.

According to a second aspect of the present invention, there is provided a pallet for transportation and handling of goods, the pallet comprising: a base; a deck above the base for supporting goods; and, at least one isolator between the deck and the base arranged to provide shock and vibration isolation to the deck from the base, the isolator comprising a resilient hollow shell that is open to the atmosphere in at least one place.

A resilient hollow shell allows a large range of deflection for various load weights whilst still allowing the shock and vibration protection properties of the isolators to cushion the load. This allows a large range of loads to be transported and handled by the same pallet. This is in contrast to prior art cushioning schemes which can only safely carry very limited ranges of load due to the cushioning elements used. For example, using foam wedges or SKID-MATEs where these elements must be carefully selected for the load in question. In particular, many different types of SKID-MATE are sold for different loads having narrow weight ranges, e.g. 20 kg to 35 kg, 30 kg to 50 kg, 45 kg to 80 kg, etc. None of these is capable of the wide range of weights achievable by the preferred embodiments of the present invention.

According to a third aspect of the present invention, there is provided a method of manufacturing a pallet for transportation and handling of goods, the method comprising: fixing at least one location element between a deck and a base, the location element arranged to substantially limit lateral motion of the deck relative to the base; and, fixing at least one isolator between the deck and the base arranged to provide shock and vibration isolation to the deck from the base.

The position of at least one isolator may be selected depending on the weight distribution of the load. In particular, a central isolator may be moved forward/rearward to counteract the centre of gravity of the load being off centre.

According to a fourth aspect of the present invention, there is provided a method of manufacturing a pallet for transportation and handling of goods, the method comprising fixing at least one isolator between a deck and a base, the isolator arranged to provide shock and vibration isolation to the deck from the base, the isolator comprising a resilient hollow shell that is open to the atmosphere in at least one place.

According to a fifth aspect of the present invention, there is provided a method of transporting or handling goods, the method comprising: transporting or handling the goods whilst loaded onto a pallet, the pallet comprising: a base; a deck above the base for supporting goods; at least one location element between the deck and the base arranged to substantially limit lateral motion of the deck relative to the base; and, at least one isolator between the deck and the base arranged to provide shock and vibration isolation to the deck from the base.

According to a sixth aspect of the present invention, there is provided a method of transporting or handling goods, the method comprising: transporting or handling the goods whilst loaded onto a pallet, the pallet comprising: a base; a deck above the base for supporting goods; and, at least one isolator between the deck and the base arranged to provide shock and vibration isolation to the deck from the base, the isolator comprising a resilient hollow shell that is open to the atmosphere in at least one place.

Preferably, the isolator or isolators provide shock and vibration isolation within a frequency range of 2 to 200 Hz to the deck for goods having a mass of between 100 kg to 2000 kg. This for example allows different products or different configurations of a product having different weights to be shipped to a customer using the same pallet without any reconfiguration required, whilst still providing adequate shock and vibration protection. This is particularly advantageous when applied to any rack-based electronic equipment, which can be shipped fully assembled in multiple configurations, which allows the rack to be configured to the customer's specification at the manufacturing base before it is shipped, thereby reducing down installation time at the destination.

Preferably the isolator comprises an elastomer. Elastomers such as natural rubber of neoprene are particularly suitable for providing the isolation between the base and deck of the pallet which can resiliently deform and give good shock and vibration isolation with a large range of load weights. This is in contrast with prior art attempts to provide cushioning to a load by using foam wedges, or SKID-MATEs which do not deform in the same way as an elastomer and which can only provide cushioning to a very narrow range of weights.

Preferably the isolator comprises a resilient material.

Preferably, the isolator comprises a hollow shell that is open to the atmosphere in at least one place. Thus, the walls of the shell provide a springiness to the isolator to allow a large range of deflection under different loads whilst providing shock and vibration protection.

Preferably, the shell is generally in the shape of an open-ended hemisphere. This is a particularly preferred shape for the isolator, providing good strength, rigidity and performance.

In an embodiment, the isolator comprises two hollow shells positioned back-to-back, each attached to a base plate, the two base plates being fixed to the base of the pallet and the deck respectively. For example, commercially available marine engine mounts of an appropriate type can be fixed back to back and used to provide the isolators. Alternatively, a custom made isolator can be used.

In a preferred embodiment, the location element comprises a dowel fixed to one of the base and the deck, the dowel being movably received in a sleeve fixed to the other of the base and the deck such that the dowel can move in the sleeve only in a direction substantially perpendicularly to the base. The location elements provide a telescopic movement in one axis between the deck and the base. The use of telescopic location elements optimises the performance of the isolators by maintaining a single axis of transition of the deck relative to the base, i.e. in a vertical direction with the pallet level.

In an embodiment, the dowel and/or sleeve are constructed and arranged to provide a low friction interface to each other. This helps provide free movement of the dowel in the sleeve even where the pallet is not level.

Preferably, at least one isolator is provided for each corner of the pallet. This provides improved stability to the pallet deck.

In an embodiment, the isolators are arranged in plural rows of plural isolators.

In an embodiment, the base comprises at least three base boards, each base board having two or more isolators. Using three base boards is easily compatible for making the pallet accessible for fork lift entry from at least two directions. Larger pallet sizes may have more than three. Using two or more isolators on each base board provides stability. More isolators can be provided if desired, e.g. to accommodate higher loads. In preferred arrangements, the isolators are arranged in three rows or three isolators.

In an embodiment, the pallet comprises plural locating elements, at least one locating element being fixed on each row. By keeping the locating elements in the same rows as the isolators, and not in between, space can be made for fork lift entry.

It will be appreciated that any features expressed herein as being provided "in one example" or as being "preferable" may be provided in combination with any one or more other such features together with any one or more of the aspects of the present invention.

Embodiments of the present invention will now be described by way of example with reference to the accompanying drawings, in which.

Figure 1:
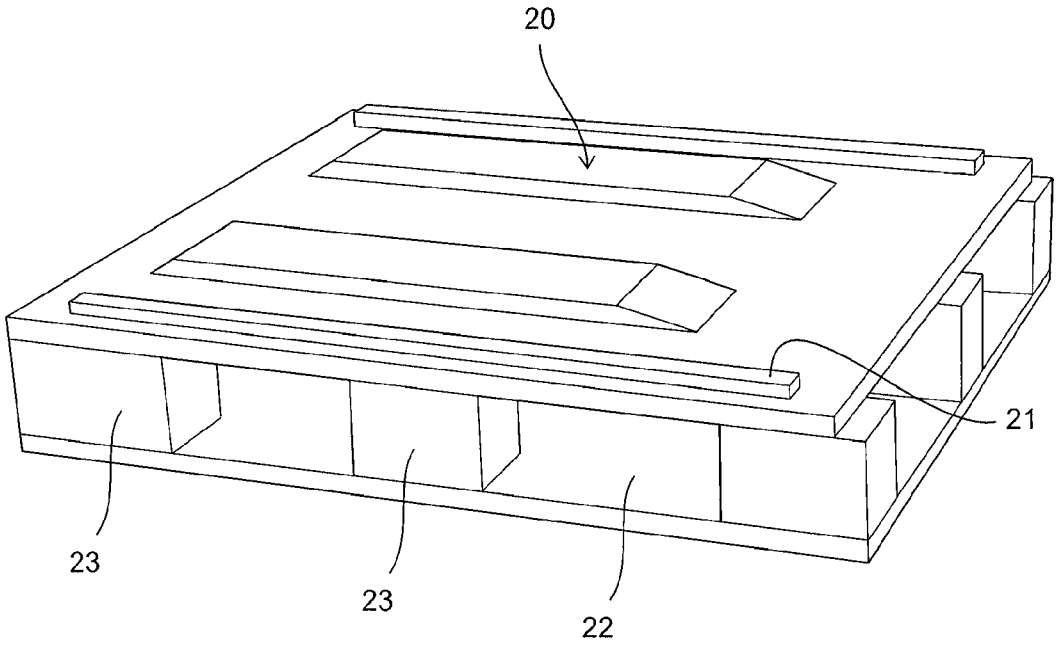
PRIOR ART Fig. 1
FIG. 1 shows a perspective view of a prior art pallet including a known cushioning scheme.
Figure 2A:
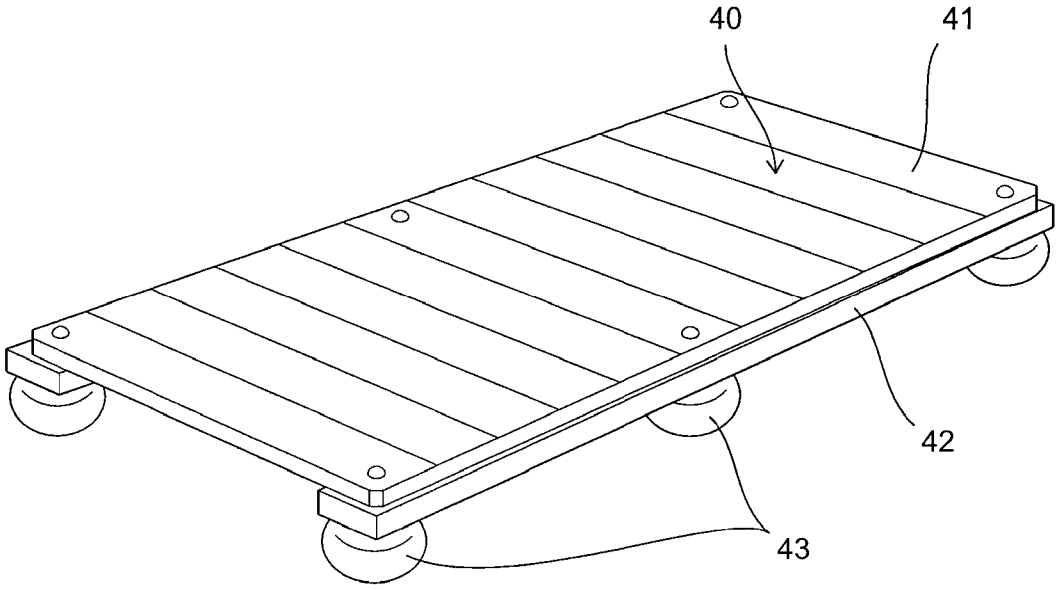
PRIOR ART Fig. 2A
FIG. 2A shows a perspective view of a prior art pallet including another known cushioning scheme and FIG. 2B shows a cross section of a detail of FIG. 2A.
Figure 2B:
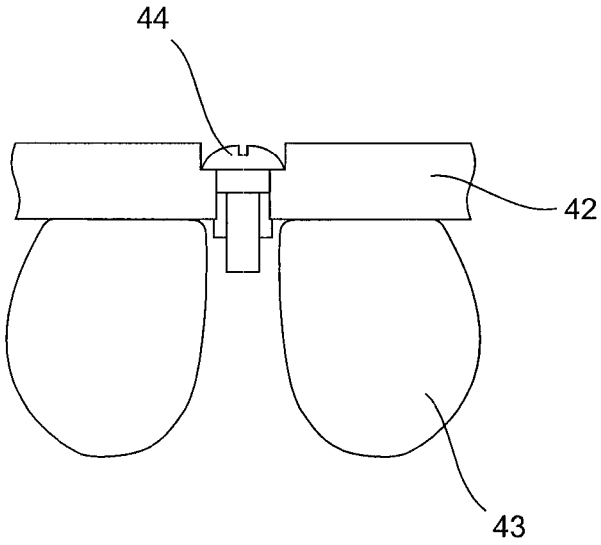
PRIOR ART Fig. 2B
Figure 3:
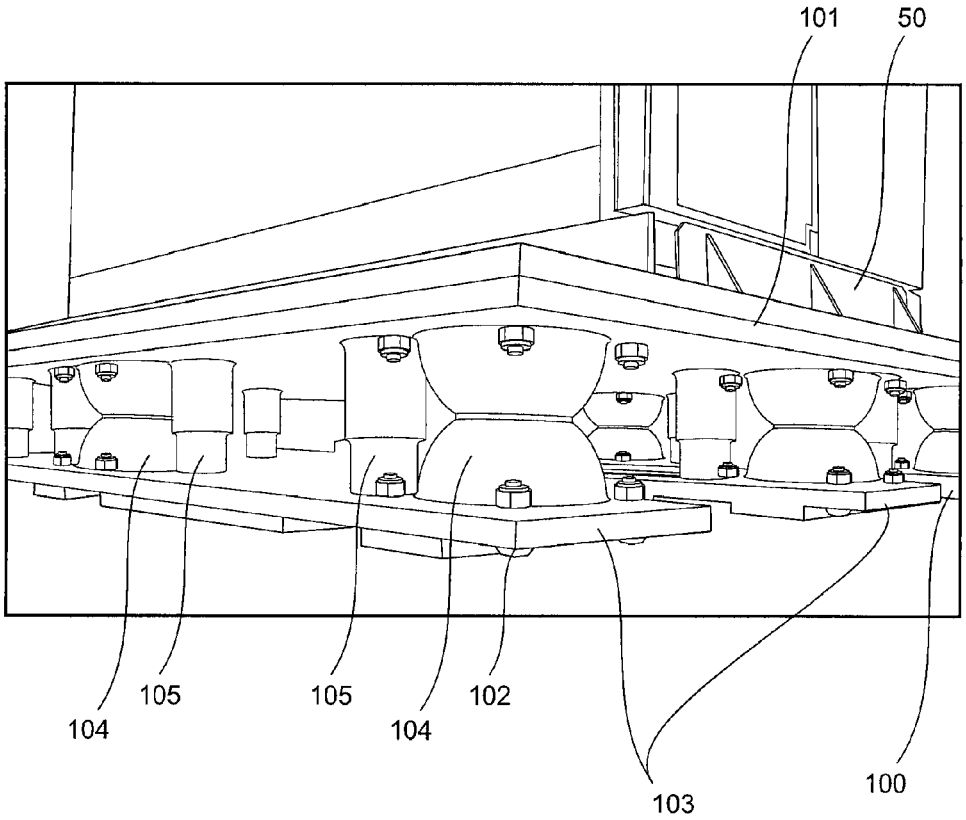
FIG. 3 shows a perspective view of an example of a pallet according to an embodiment of the present invention.

FIG. 3 shows a perspective view of an example of a pallet 100 according to an embodiment of the present invention. The pallet 100 comprises a deck 101. The deck 101 is preferably rectangular or square platform which supports a load 50 either directly or indirectly. The pallet has a base 102 (or lower deck) which in this example comprises three base boards 103. The base boards 103 run from front to back of the pallet 100 in parallel, spaced-apart relationship and generally occupy the same footprint as the deck 101. Skid runners may be provided below the base 102 if required.

A plurality of isolators 104 are fixed between the deck 101 and the base 102. A plurality of location elements 105 are also fixed between the deck 101 and the base 102. The isolators 104 and the location elements 105 together support the deck 101 above the base 102. The isolators 104 and location elements 105 are positioned such that a fork lift can at least one side, i.e. by positioning the forks in the channels between the base boards 103.

Figure 4:
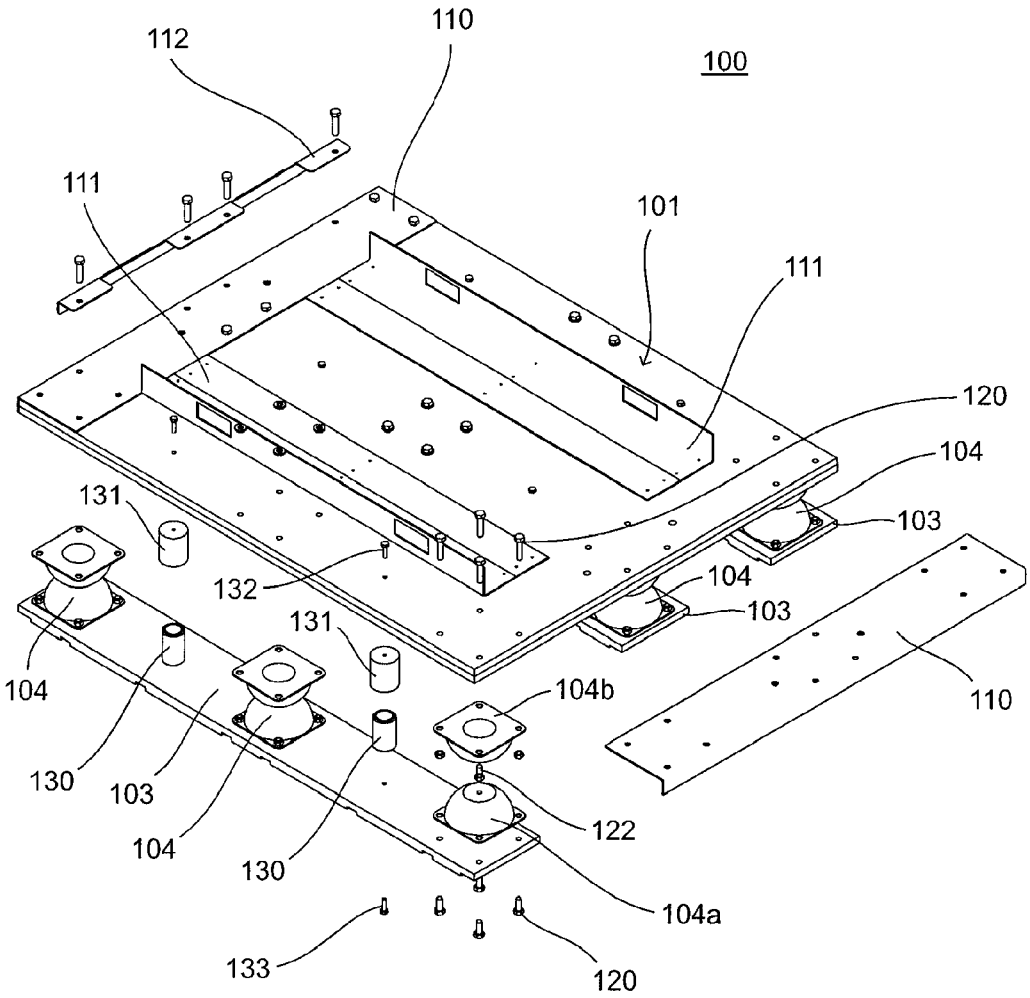
FIG. 4 shows an exploded view of the example of the pallet of FIG. 3; and, FIG. 5 shows a detail view of an isolator of FIG. 4.

Referring to FIG. 4, the deck 101 may have further elements or structures 110,111,112 fixed to it to provide additional protection to the deck 101, or to facilitate securing the goods on the deck 101, or loading/unloading the goods. If desired, a crate may be built on the deck 101.

Still referring to FIG. 4, the location elements 105 provide a telescopic movement in one axis between the deck 101 and the base 102. The location elements 105 comprise a cylindrical sleeve 131 fixed to the underside of the deck 101 by a fastener 132, and a cylindrical dowel or pin 130 fixed to the top side of the base 102 by a fastener 133. The dowel 130 is received in the sleeve 131 wherein it has a close fit but with some small tolerance, e.g. 0.5 mm, which allows the dowel 130 to move in the sleeve in a single axial direction which is perpendicular to the base 102 and deck 101. Preferably the dowel 130 and/or sleeve 131 are constructed and arranged to have a low friction coefficient between them to allow the dowel 130 to move smoothly in the sleeve 131 even where the pallet 100 is not level. In the present example, the dowel 130 is made from oil filled nylon, and the sleeve 131 is made from aluminium. The use of telescopic location elements 105 optimises the performance of the anti-vibration mounts by maintaining a single axis of transition of the deck 101 relative to the base, i.e. in a vertical direction with the pallet level.

The isolators 104 in this example are constructed from two identical isolator elements 104*a*,104*b* which are fixed together back-to-back by a fastener 122 at one end. The other ends and respectively fixed to the underside of the deck 101 and the top side of the base 102 by fasteners 120. (NB, not all instances of the fasteners are shown in FIG. 4 for clarity.)

Figure 5:
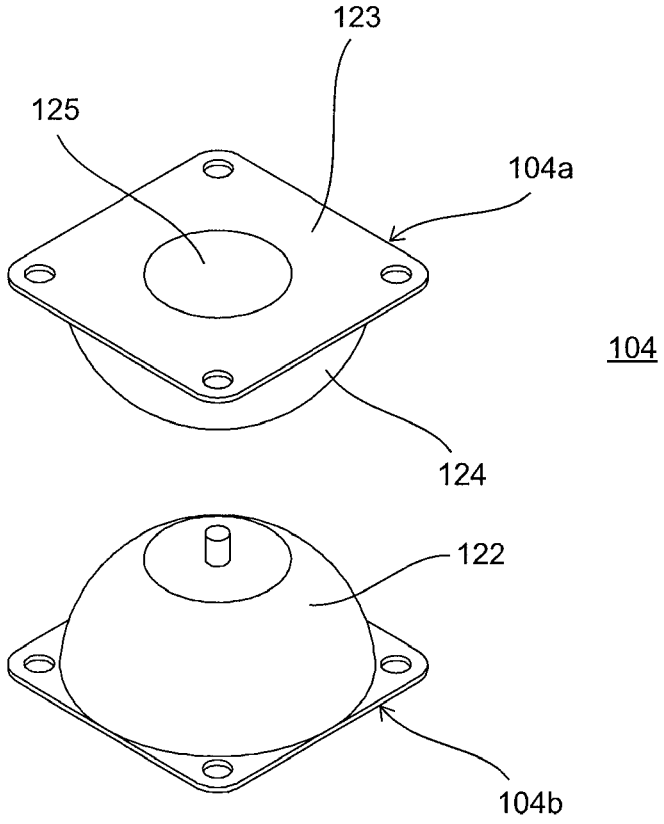

FIG. 5 shows a detail view of the two isolator elements 104*a*,104*b* of the isolator 104. Each isolator element 104*a*, 104*b* comprises a metal plate 123 for fixing to the base 102/deck 101 and a resilient element 124 in the form of a hollow shell made from an elastomer, and preferably in the general shape of a hemisphere, the open end of which is attached to the plate 123. The plate 123 has a hole in its centre 125, such that the interior of the elastomer shell is open to the atmosphere. The fastener 122 passes through holes in the tops of the shells 124 to secure them back-to-back together. By placing two isolator elements back to back, the displacement achieved by the isolator 104 is doubled. For heavier loads, more than two isolator elements in a stack can be used. The elastomer can be a natural rubber or neoprene for example. The hollow shell form of the resilient element 124 means that the isolator element 104*a*,104*b* can deform to varying degrees under varying loads and protect against shock and vibration over a wide range of loads. Elastomers provide inherent damping and characteristics can be moulded into the desired shape. The walls of the resilient element 124 can be made more or less thick to provide more or less springiness. The isolators 104*a*,104*b* can thus be tuned to suit the particular range of load weights by their materials, construction, number and placement.

In a preferred example, nine isolators 104 are provided, three for each of the three base boards 103. For each base board 103, the isolators 104 are located at both ends of the base board 103 and in the middle. Thus, the isolators 104 are arranged in a 3 by 3 grid. If desired, the position of the central isolator 104 of the central base board 103 can be moved forwards/backwards to allow for goods where the centre of gravity is off centre relative to the dimensions of the good and/or the pallet 101.

Preferably plural location elements 104 are provided. In the present example, a location element 104 is provided between each adjacent pair of isolators 104 on each base board 103.

The system of isolators 104 and location elements 105 provides a pallet 100 which offers a dynamic and stable platform for shipping and handling goods via any transportation method, e.g. air, sea, rail and road freight. The preferred pallet provides vibration and shock performance for goods with a mass of 100 kg to 2000 kg. Preferably the deflection of the isolators 104 is at least 5 mm when a static load is applied and a maximum of 30 mm when under a full dynamic shock load with 2000 kg mass. As will be appreciated, the deflection of the isolators 104 will be less for lower weights. The precise deflection range is not important. What is more important is that the isolators do not run out of "travel" when the high masses are applied when the pallet experiences a violent shock, i.e. when it is dropped. A preferred material hardness is about 45 shore, which gives good isolation from shock and vibration for the load range. As will be appreciated, different hardness values may be used for different load ranges.

As will be appreciated, the principles disclosed herein can be applied to a wide variety of pallet designs. A preferred embodiment, the pallet is at least 100 cm wide by 100 cm deep.

Suitable isolator elements 104*a*,104*b* are manufactured and sold for the purposes of mounting marine engines to stop vibration from the engine escaping to the surroundings. This provides a lower cost way to manufacture the pallet 100 using off-the-shelf parts for the isolators 104. The present embodiment uses the marine engine mounts in a novel and inventive way in mounting them back-to-back and incorporating them into a pallet system. Alternatively, a custom isolator 104 can be provided comprising one or more resilient hollow shells.

Preferably the isolators 104 are arranged such that the pallet 100 can handle the range of weights of the load having a resonant frequency of at least 6 Hz and preferably 12 Hz or higher.

The pallet 100 is particularly suited to transportation and handling of heavy electronic goods, such as for example storage enclosures, servers, computer equipment and rack mounted systems, etc. In particular, rack mounted electronic equipment can be configured in different ways and can therefore have different weights which must be shipped to a customer. For example, the Clusterstor rack system manufactured by the present applicant can be very heavy depending on how it is configured. The preferred embodiment can be used with a wide weight range of 100 kg to 2000 kg which allows different configurations of racks to be shipped to a customer. The alternative is to breakdown the racks into separate units and to ship these individually. However, this is less efficient for transportation and storage. This is also not preferred by the customer, as the equipment must be reassembled when it arrives at its destination. The present embodiment allows the rack to be shipped fully assembled, which allows the rack to be configured at the manufacturing base before it is shipped. This means the system can be expected to work when it is delivered, which beneficially reduces installation time which can otherwise be a lengthy process for some systems.

Embodiments of the present invention have been described with particular reference to the example illustrated. However, it will be appreciated that variations and modifications may be made to the examples described within the scope of the present invention.

The invention claimed is:

1. A pallet for transportation and handling of goods, the pallet comprising:

a base;

a deck above the base for supporting goods;

at least one location element between the deck and the base arranged to substantially limit lateral motion of the deck relative to the base; and, at least one isolator between the deck and the base arranged to provide shock and vibration isolation to the deck from the base, wherein the isolator or isolators are arranged to provide shock and vibration isolation within a frequency range of 2 to 200 Hz to the deck for goods having a mass of between 100 kg to 2000 kg.

2. A pallet according to claim 1, wherein the isolator comprises an elastomer.

3. A pallet according to claim 1, wherein the isolator comprises a resilient material.

4. A pallet according to claim 3, wherein the isolator comprises a hollow shell that is open to the atmosphere in at least one place.

5. A pallet according to claim 4, wherein the shell is generally in the shape of an open-ended hemisphere.

6. A pallet according to claim 5, wherein the isolator comprises two hollow shells positioned back-to-back, each attached to a base plate, the two base plates being fixed to the base of the pallet and the deck respectively.

7. A pallet according to claim 1, wherein the location element comprises a dowel fixed to one of the base and the deck, the dowel being movably received in a sleeve fixed to the other of the base and the deck such that the dowel can move in the sleeve only in a direction substantially perpendicularly to the base.

8. A pallet according to claim 7, wherein the dowel or sleeve or both are constructed and arranged to provide a low friction interface to each other.

9. A pallet according to claim 1, comprising at least one isolator for each corner of the pallet.

10. A pallet according to claim 9, wherein the isolators are arranged in plural rows of plural isolators.

11. A pallet according to claim 10, wherein the base comprises at least three base boards, each base board having at least two isolators.

12. A pallet according to claim 10, comprising plural location elements, at least one location element being fixed on each row.

13. A pallet for transportation and handling of goods, the pallet comprising:

a base;

a deck above the base for supporting goods; and, at least one isolator between the deck and the base arranged to provide shock and vibration isolation to the deck from the base, the isolator comprising a resilient hollow shell that is open to the atmosphere in at least one place.

14. A method of manufacturing a pallet for transportation and handling of goods, the method comprising:

fixing at least one location element between a deck and a base, the location element arranged to substantially limit lateral motion of the deck relative to the base; and, fixing at least one isolator between the deck and the base arranged to provide shock and vibration isolation to the deck from the base, wherein the isolator or isolators are arranged to provide shock and vibration isolation within a frequency range of 2 to 200 Hz to the deck for goods having a mass of between 100 kg to 2000 kg.

15. A method of manufacturing a pallet for transportation and handling of goods, the method comprising fixing at least one isolator between a deck and a base, the isolator arranged to provide shock and vibration isolation to the deck from the base, the isolator comprising a resilient hollow shell that is open to the atmosphere in at least one place.

16. A method of transporting or handling goods, the method comprising:

transporting or handling the goods whilst loaded onto a pallet, the pallet comprising:

a base;

a deck above the base for supporting goods;

at least one location element between the deck and the base arranged to substantially limit lateral motion of the deck relative to the base; and, at least one isolator between the deck and the base arranged to provide shock and vibration isolation to the deck from the base, wherein the isolator or isolators are arranged to provide shock and vibration isolation within a frequency range of 2 to 200 Hz to the deck for goods having a mass of between 100 kg to 2000 kg.

17. A method of transporting or handling goods, the method comprising:

transporting or handling the goods whilst loaded onto a pallet, the pallet comprising:

a base;

a deck above the base for supporting goods; and, at least one isolator between the deck and the base arranged to provide shock and vibration isolation to the deck from the base, the isolator comprising a resilient hollow shell that is open to the atmosphere in at least one place.

* * * * *